US005505061A

United States Patent [19]

Fleury, Jr. et al.

[11] Patent Number: 5,505,061

[45] Date of Patent: Apr. 9, 1996

[54] JEWELRY ARTICLES WITH INTERCHANGEABLE ORNAMENTS

[76] Inventors: Edward J. Fleury, Jr., 15 Ambrose St., North Providence, R.I. 02904; Debra A. Scorpio, 248 Spring Grove Rd., Gloucester, R.I. 02814; James R. Wilson, 33 Ida St., Providence, R.I. 02909

[21] Appl. No.: 308,941

[22] Filed: Sep. 19, 1994

[51] Int. Cl.[6] ..... A44C 7/00; A44C 17/00

[52] U.S. Cl. ..... 63/29.1; 63/13

[58] Field of Search ..... 63/12, 13, 2, 1.1, 63/29.1

[56] References Cited

U.S. PATENT DOCUMENTS

| | | | |
|---|---|---|---|
| 466,287 | 12/1891 | Berlepsch | 63/29.1 |
| 1,052,141 | 2/1913 | Gaschke | 63/29.1 |
| 2,316,225 | 4/1943 | Hoffman | 63/29.1 |
| 3,418,826 | 12/1968 | Wieshuber | 63/29.1 |
| 3,831,398 | 8/1974 | Davis | 63/2 |
| 3,905,525 | 9/1975 | Kawamata | 63/29.1 |
| 4,781,036 | 11/1988 | Erickson . | |
| 4,783,974 | 11/1988 | Hernandez . | |
| 4,899,556 | 2/1990 | Ford | 62/29.1 |
| 5,048,310 | 9/1991 | Riley . | |
| 5,048,311 | 9/1991 | Mastrobuono . | |
| 5,170,641 | 12/1992 | DiDomenico . | |

*Primary Examiner*—Flemming Saether
*Attorney, Agent, or Firm*—Salter & Mcihaelson

[57] ABSTRACT

Jewelry apparatus consists of a body portion having an ornamental outer surface and an ornament portion having an ornamental outer surface. The body portion includes an engagement formation preferably consisting of a cylindrical recess and a bore which extends axially inwardly from the center of the cylindrical recess. The ornament portion includes a complimentary engagement formation preferably consisting of a cylindrical neck which is slidably received in the recess of the body portion, and a post which is slidably received in the bore. When the engagement surfaces of the body and ornament portions are received in engagement, the ornamental surfaces thereof cooperatively merge so that the body portion and the ornament portion appear as an integral unit. The post frictionally secures the ornament portion to the body portion when received into the bore. Because the post and bore are located on the engagement surfaces, they are substantially concealed when the body and ornament portions are received in engagement. The jewelry apparatus further includes mounting apparatus, such as a post and clutch, for mounting the assembled jewelry apparatus on a wearer.

11 Claims, 2 Drawing Sheets

JEWELRY ARTICLES WITH INTERCHANGEABLE ORNAMENTS

BACKGROUND AND SUMMARY OF THE INVENTION

The instant invention relates to jewelry articles and more particularly to apparatus for interchanging ornaments on a jewelry article.

Jewelry articles with interchangeable ornaments and adapters for adapting one type of jewelry article into another type are well known in the art. However, the majority of commercially available interchangeable jewelry apparatus have one major drawback: the interchanging apparatus for connecting the separable portions is usually large and unsightly. It is a primary objective in creating an interchangeable jewelry article that the interchanging apparatus be easy to handle. If the apparatus is too small or difficult to handle, most consumers will quickly become discouraged and discontinue use. However, another important object in designing interchangeable jewelry articles is that the interchanging apparatus be substantially hidden from view when the jewelry article is assembled for wear. It is e obvious that these two objectives are contradictory in nature. One objective requires that the apparatus be large enough to be easily handled while the other objective requires that the apparatus be small enough to conceal. In order to achieve both objectives, the prior art devices have traditionally been limited to use on jewelry articles having large ornaments with adequate surface area for mounting of the apparatus and for obstructing view of the apparatus.

Accordingly, among the several objects of the instant invention are: the provision of jewelry apparatus wherein the interchanging or securing apparatus is substantially concealed from view when the separable portions of the jewelry apparatus are received in engagement; and the provision of jewelry apparatus wherein the body portion and the interchangeable ornament portion have ornamental surface features which cooperatively merge so that the body and ornament portions appear as an integral unit when received together.

The instant invention accomplishes these objectives by providing jewelry apparatus comprising a body portion having an ornamental outer surface and an engagement surface, and further comprising an ornament portion having an ornamental outer surface and an engagement surface. The engagement surface of the body portion preferably includes an engagement formation comprising a cylindrical recess and a bore which extends axially inwardly from the center of the cylindrical recess. The engagement surface of the ornament portion preferably includes an engagement formation comprising a cylindrical neck and a post which extends axially outwardly therefrom. The cylindrical neck and post of the ornament portion are slidably received in interfitting engagement into the complimentary recess and bore of the body portion. When the body portion and ornament portion are received in engagement, the ornamental surfaces thereof cooperatively merge so that the body portion and the ornament portion appear as an integral unit. The post frictionally secures the ornament portion to the body portion when received into the bore. It is noted that the post and bore on the engagement surfaces are substantially concealed when the body and ornament portions are received in engagement. The jewelry apparatus further includes mounting apparatus, such as a post and clutch, for mounting the assembled jewelry apparatus on a wearer.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 3 is a cross-sectional view thereof taken along line 3—3 of. FIG. 1;

DESCRIPTION OF THE PREFERRED EMBODIMENT

Figure 1:
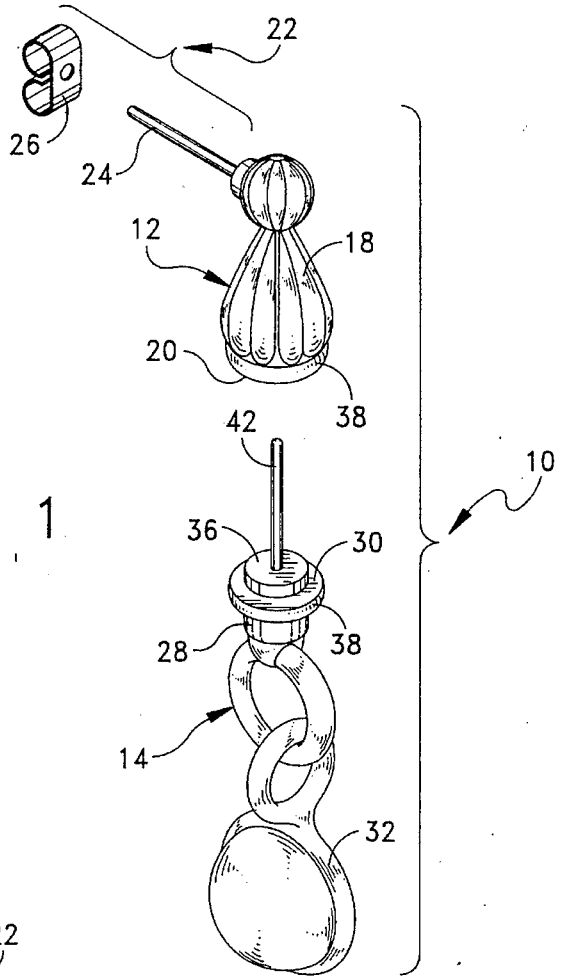
FIG. 1 is a perspective view of the jewelry apparatus.
Figure 2:
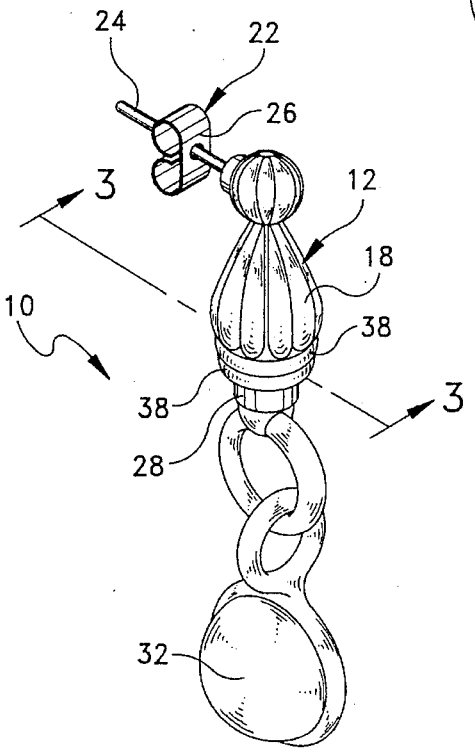
FIG. 2 is an exploded perspective view thereof.
Figure 3:
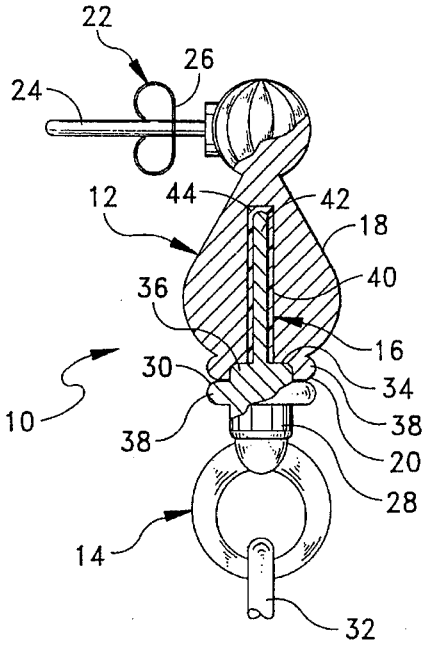

Referring now to the drawings, the jewelry apparatus of the instant invention is illustrated and generally indicated at 10 in FIGS. 1–4. As will hereinafter be more fully described, jewelry apparatus 10 includes interchangeable ornaments wherein the apparatus for securing the ornament portion to a body portion is substantially concealed, and the body portion and ornament portion appear as an integral unit.

Jewelry apparatus 10 comprises a body portion generally indicated at 12, an ornament portion generally indicated at 14, and securing apparatus generally indicated at 16 (FIG. 3) for securing ornament portion 14 to body portion 12. Body portion 12 includes an ornamental outer surface 18, an engagement surface 20, and mounting apparatus generally indicated at 22 for mounting body portion 12 to a wearer. Mounting apparatus 22 preferably comprises a post 24 and clutch 26 which are suitable for mounting of jewelry apparatus 10 either as an earring, or as a pin. However, other mounting apparatus, such as clip-on earring mounts, and necklace chains are also contemplated. Ornament portion 14 includes an ornamental outer surface 28, and an engagement surface 30. Ornament portion 14 further comprises a hanging ornament 32 which is attached to the ornament portion by interlocking loops.

The engagement surfaces 20,30 of body portion 12 and ornament portion 14 preferably include interfitting mateable formations for interfitting mated engagement of body portion 12 and the ornament portion 14. In the instant embodiment, the mateable formations comprise a recess 34 (FIG. 3) formed in engagement surface 20 of body portion 12, and a cylindrical neck 36 extending outwardly from engagement surface 30 of ornament portion 14. To assemble jewelry apparatus 10, neck 36 is slidably received into recess 34. It is pointed out that when the body and ornament portions 12,14 are interfittingly engaged, ornamental outer surfaces 18,28 cooperatively merge so that body portion 12 and ornament portion 14 appear as an integral unit. In this regard, ornamental outer surfaces 18,28 may include ornamental formations, such as rounded shoulders 38 having a semicircular cross-sectional shape, adjacent the engagement surfaces 20,30 to further enhance and disguise the engagement point of body portion 12 and ornament portion 14. More specifically, the rounded shoulders 38 of the body portion 12 and ornament portion 14 merge in such a manner that a line of demarcation between the body portion 12 and the ornament portion 14 is hidden in a recessed groove formed between the shoulder portions 38 (See FIG. 3). While the interfitting formations are described in detail as comprising a cylindrical recess 34 and neck 36, it is to be understood that other interfitting formations, are also contemplated within the scope of the invention.

Jewelry apparatus 10 further includes securing apparatus 16 for securing ornament portion 14 and body portion 12 in interfitting engagement. Securing apparatus 16 is preferably located on the interfitting formations of body portion 12 and ornament portion 14 so that securing apparatus 16 is concealed from view when body portion 12 and ornament portion 14 are received in interfitting engagement. In this connection, securing apparatus 16 preferably comprises an axial bore 40 (FIG. 3) extending inwardly from the center of cylindrical recess 34 and an axial post 42 extending outwardly from neck 36. When ornament portion 14 and body portion 12 are received in interfitting engagement, post 42 is slidably received into bore 40 to secure the apparatus 10 together. Bore 40 preferably includes a polyethylene liner 44, or sleeve, to frictionally hold post 42 therein. Accordingly, when ornament portion 14 and body portion 12 are received and secured together, they appear as an integral unit. Ornamental surfaces 18,28 cooperatively merge together, and the securing apparatus 16 is concealed within the interior of the apparatus 10 to create the elegant appearance of a single integral unit.

Figure 4:
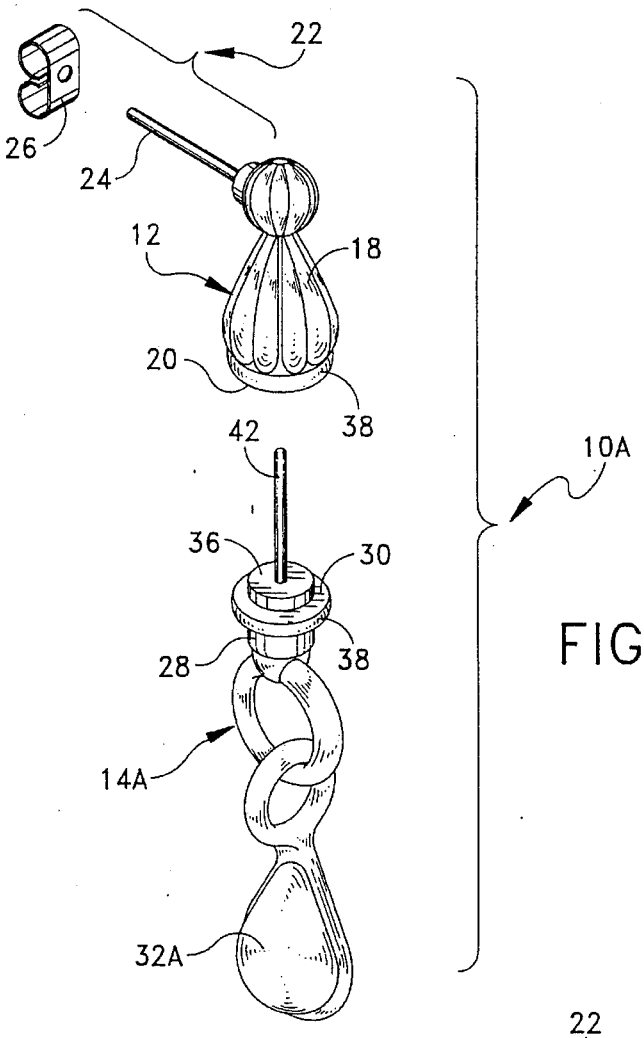
FIG. 4 is another exploded perspective view thereof showing a different interchangeable ornament.

Referring now to FIG.4, an alternative jewelry apparatus is generally indicated at 10A. In this connection, body portion 12 is illustrated in conjunction with a second interchangeable ornament portion 14A. Ornament portions 14, 14A are easily interchangeable simply by separating the ornament portion 14 from body portion 12 and replacing it with another interchangeable ornament portion 14A, such as illustrated in FIG. 4.

Figure 5:
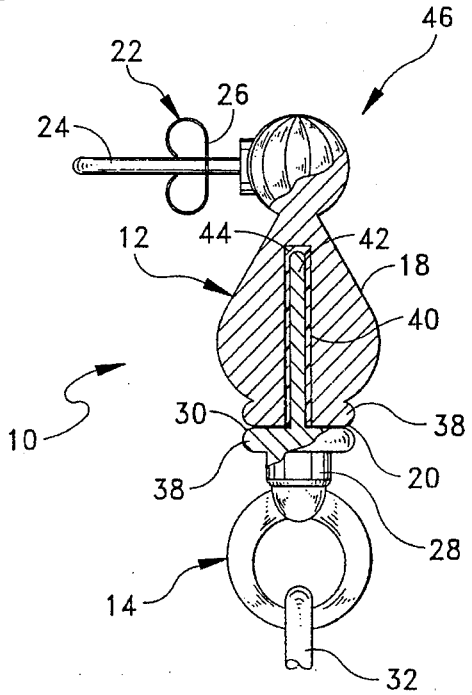
FIG. 5 is a cross-sectional view of an alternative embodiment of the jewelry apparatus.

Referring now to FIG. 5, an alternative embodiment of the instant jewelry apparatus is illustrated and generally indicated at 46. Jewelry apparatus 46 is substantially identical to jewelry apparatus 10 except that the engagement surfaces 20,30 do not include any interfitting formations. As illustrated in FIG. 5, bore 40 is formed directly in engagement surface 20, and post 42 extends outwardly from engagement surface 30. It is pointed out that the interfitting formations, i.e. recess 34 and neck 36, are not considered crucial to the invention. However, the formations do provide additional stability to the apparatus.

While the instant jewelry apparatus 10, 10A and 46 are specifically illustrated and described as comprising earrings, it is to be understood that jewelry apparatus 10, 10A and 46 can be incorporated into any type of hanging jewelry article, such as pendants and necklaces.

It can therefore be seen that the instant invention provides a unique and effective jewelry apparatus wherein the interchanging or securing apparatus is substantially concealed from view when the separable portions of the jewelry apparatus are received in engagement. The instant invention further provides jewelry apparatus wherein the body portion and the interchangeable ornament portion have ornamental surface features which cooperatively merge so that the body and ornament portions appear as an integral unit when received together. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. Jewelry apparatus comprising:

a body portion having an ornamental outer surface and an engagement surface, said ornamental outer surface including a rounded shoulder portion adjacent to said engagement surface and merging with said engagement surface, said rounded shoulder portion having a generally semicircular configuration when viewed in cross-section;

mounting apparatus for mounting said body portion on a wearer's ear lobe;

an ornament portion having an ornamental outer surface, and an engagement surface, said ornamental outer surface including a rounded shoulder portion adjacent to said engagement surface and merging with said engagement surface, said rounded shoulder portion having a generally semicircular configuration when viewed in cross-section;

interfitting mateable formations on said engagement surfaces of said body portion and said ornament portion for interfitting mated engagement of said engagement surfaces of said body portion and said ornament portion, said rounded shoulders of said ornamental surfaces of said body portion and said ornament portion cooperatively merging in such a manner that a line of demarcation between said body portion and said ornament portion is hidden in recessed groove formed between said rounded shoulders and said body portion and said ornament portion appear as an integral unit when interfittingly engaged; and securing apparatus on said interfitting mateable formations for securing said ornament portion to said body portion when engaged, said securing apparatus being hidden from view when said body portion and said ornament portion are interfittingly engaged.

2. In the jewelry apparatus of claim 1, said mounting apparatus comprising a post and clutch.

3. In the jewelry apparatus of claim 1, said interfitting mateable formations comprising a neck and a corresponding recess.

4. In the jewelry apparatus of claim 3, said securing apparatus comprising a bore and a post.

5. In the jewelry apparatus of claim 4, said bore including a plastic sleeve therein for slidably and frictionally receiving said post.

6. In the jewelry apparatus of claim 5, said post extending outwardly from said neck and said bore being formed in said recess.

7. In the jewelry apparatus of claim 1, said interfitting mateable formations comprising a cylindrical neck and a cylindrical recess having a slightly larger diameter than said cylindrical neck.

8. In the jewelry apparatus of claim 7, said neck being disposed on said ornament portion and said recess being disposed on said body portion.

9. In the jewelry apparatus of claim 8 said securing apparatus comprising a post and a bore, said post extending outwardly from said cylindrical neck and bore being formed in said recess.

10. In the jewelry apparatus of claim 1, said securing apparatus comprising a bore and a post.

11. In the jewelry apparatus of claim 10, said bore including a plastic sleeve therein for slidably and frictionally receiving said post.

* * * * *